US011389978B2

(12) United States Patent
Barrett et al.

(10) Patent No.: US 11,389,978 B2
(45) Date of Patent: Jul. 19, 2022

(54) RAZOR APPARATUS AND SHAVING SYSTEM

(71) Applicant: OneBlade, Inc., Coral Gables, FL (US)

(72) Inventors: Tod Barrett, Coral Gables, FL (US); Porter Stansberry, Coral Gables, FL (US); Mark Prommel, Coral Gables, FL (US)

(73) Assignee: Oneblade, Inc., Coral Gables, FL (US)

( * ) Notice: Subject to any disclaimer, the term of this patent is extended or adjusted under 35 U.S.C. 154(b) by 95 days.

(21) Appl. No.: 16/561,754

(22) Filed: Sep. 5, 2019

(65) Prior Publication Data

US 2020/0094427 A1 Mar. 26, 2020

Related U.S. Application Data

(63) Continuation of application No. 14/875,484, filed on Oct. 5, 2015, now Pat. No. 10,406,704.

(60) Provisional application No. 62/174,067, filed on Jun. 11, 2015, provisional application No. 62/135,592, filed on Mar. 19, 2015, provisional application No. 62/060,410, filed on Oct. 6, 2014.

(51) Int. Cl.

| | |
|---|---|
| ***B26B 21/16*** | (2006.01) |
| ***B26B 21/40*** | (2006.01) |
| ***B26B 21/52*** | (2006.01) |
| ***A45D 27/22*** | (2006.01) |
| ***A45D 27/04*** | (2006.01) |

(52) U.S. Cl.

CPC ..... *B26B 21/16* (2013.01); *A45D 27/04* (2013.01); *A45D 27/22* (2013.01); *B26B 21/4018* (2013.01); *B26B 21/4025* (2013.01); *B26B 21/521* (2013.01); *B26B 21/522* (2013.01)

(58) Field of Classification Search

CPC . B26B 21/16; B26B 21/4012; B26B 21/4018; B26B 21/4025; B26B 21/4031; B26B 21/52–522; B26B 21/527; B26B 21/227

USPC ..... 30/47–51, 64, 526–536; D28/45–48

See application file for complete search history.

(56) References Cited

U.S. PATENT DOCUMENTS

| | | | |
|---|---|---|---|
| 1,053,089 | A | 2/1913 | Holm |
| 1,057,644 | A | 4/1913 | Hiener |
| 1,117,953 | A | 11/1914 | Crandall |
| 1,169,395 | A | 1/1916 | Greist |
| 1,200,426 | A | 10/1916 | King |
| 1,234,834 | A | 7/1917 | Warren |
| 1,460,139 | A | 6/1923 | Rarker |
| 1,633,139 | A | 6/1927 | Staats-oels |
| 2,018,304 | A | 10/1935 | Hayhurst |
| 2,019,957 | A | 11/1935 | England |

(Continued)

FOREIGN PATENT DOCUMENTS

| | | | | |
|---|---|---|---|---|
| CA | 3038653 A1 * | 5/2018 | ..... | B26B 21/227 |
| EP | 3532256 B1 * | 6/2021 | ..... | B26B 21/227 |
| WO | 95/29798 | 11/1995 | | |

*Primary Examiner* — Jason Daniel Prone

(74) *Attorney, Agent, or Firm* — Kowert, Hood, Munyon, Rankin & Goetzel, P.C.; Gareth M. Sampson; Dean M. Munyon

(57) ABSTRACT

A shaving razor apparatus provides (a) a shaving tool having (i) a handle; and (ii) a pivotable head mounted on the handle with a blade receiving and holding mechanism for receiving and holding a single edge razor blade suitable for cutting hair follicles. The shaving system further provides optional accessories.

20 Claims, 7 Drawing Sheets

(56) References Cited

U.S. PATENT DOCUMENTS 2,030,833 A 2/1936 Thompson
2,077,241 A 4/1937 Karle
2,108,758 A 2/1938 Thompson
2,161,403 A * 6/1939 Ashworth ..... B26B 21/30 30/58
2,168,447 A 8/1939 Morehead
2,288,302 A * 6/1942 Reyburn et al. ..... B26B 21/24 30/64
2,335,547 A 11/1943 Smith
2,386,536 A 10/1945 Duryea
D143,326 S 12/1945 Kempf
D146,759 S 5/1947 Brown
2,545,533 A 3/1951 Stewart
2,580,058 A 12/1951 Oscar
2,588,211 A 3/1952 Crowell
2,682,105 A * 6/1954 Randol ..... B26B 21/16 30/64
2,715,268 A * 8/1955 Randol ..... B26B 21/16 30/64
2,744,317 A 5/1956 Borden
2,744,319 A * 5/1956 Cutler ..... B26B 21/16 D28/46
2,768,436 A * 10/1956 Randol ..... B26B 21/16 30/64
2,780,866 A 2/1957 Borden
2,794,246 A 6/1957 Marsh
2,933,808 A 4/1960 Friel
3,015,159 A 1/1962 Baun
3,045,342 A 7/1962 Diehl
3,067,512 A 12/1962 Randol
3,078,569 A 2/1963 Sidney
3,080,651 A 3/1963 Cas
3,203,093 A 8/1965 Kuhnl
3,488,764 A 1/1970 Welsh
3,583,262 A * 6/1971 Mullen ..... B26B 21/06 30/32
3,605,265 A 9/1971 Iten
3,775,845 A 12/1973 Kuhnl
3,949,470 A * 4/1976 Hall ..... B26B 21/22 30/50
D241,080 S 8/1976 Glaberson
4,026,016 A 5/1977 Nissen
D248,878 S 8/1978 Halm
D249,968 S 10/1978 Kiraly
D250,130 S 10/1978 Douglas
D250,547 S 12/1978 Palmer
4,152,828 A * 5/1979 Lund ..... B26B 21/225 30/529
D253,726 S 12/1979 Schuman et al.
4,180,907 A * 1/1980 Iten ..... B26B 21/16 30/64
4,184,246 A 1/1980 Trotta
4,198,745 A 4/1980 Moehlenpah
4,200,976 A 5/1980 Gooding
4,212,103 A 7/1980 Schuman-Hoole
D259,065 S 4/1981 Byrne
4,272,886 A 6/1981 Asano
4,275,498 A 6/1981 Ciaffone
4,328,615 A * 5/1982 Bowman ..... B26B 29/00 30/47
4,337,575 A 7/1982 Trotta
D268,291 S 3/1983 Jones
4,392,303 A * 7/1983 Ciaffone ..... B26B 21/521 30/526
4,403,412 A 9/1983 Trotta
4,446,619 A 5/1984 Jacobson
4,476,630 A 10/1984 Byrne
4,574,476 A 3/1986 Ortiz
4,617,736 A * 10/1986 McCrary ..... B26B 5/006 30/527
D293,036 S 12/1987 Iten et al.
4,813,131 A 3/1989 Gruner
4,833,779 A 5/1989 Iten
4,852,254 A 8/1989 Duncan
4,866,844 A 9/1989 Burout, III
D304,773 S * 11/1989 Beuchat ..... D28/46
4,879,811 A 11/1989 Cooney
D310,580 S 9/1990 King
4,970,784 A 11/1990 Althaus et al.
5,012,578 A * 5/1991 Siefer ..... B26B 29/00 30/47
5,048,184 A 9/1991 Saxton
5,070,612 A * 12/1991 Abatemarco ..... B26B 21/4018 30/50
5,251,376 A * 10/1993 Althaus ..... B26B 21/227 30/50
5,251,752 A 10/1993 Purohit
D345,232 S 3/1994 Gray
D354,586 S 1/1995 Grange
5,412,872 A * 5/1995 Iderosa ..... B26B 21/4012 30/50
5,416,974 A 5/1995 Wain
5,461,781 A * 10/1995 Pirc ..... B26B 21/40 30/50
5,526,567 A * 6/1996 Carson, III ..... B26B 21/522 30/50
5,526,568 A 6/1996 Copelan
5,557,851 A 9/1996 Ortiz
D375,408 S 11/1996 Muller
5,590,468 A 1/1997 Prochaska
5,687,485 A 11/1997 Shurtleff et al.
5,784,790 A 7/1998 Carson, III et al.
5,953,824 A 9/1999 Ferraro et al.
D427,376 S 6/2000 Scott
6,094,768 A * 8/2000 Hugon ..... A46B 5/00 D4/104
6,141,875 A 11/2000 Andrews
6,266,888 B1 7/2001 Zowaski
D446,884 S 8/2001 Kohring et al.
6,418,623 B1 * 7/2002 Marcarelli ..... B26B 21/4006 30/526
6,473,971 B2 11/2002 Ordaz
6,530,151 B2 3/2003 Kameka
D476,772 S * 7/2003 Wonderley ..... D28/48
6,655,029 B2 12/2003 Saito
6,694,626 B2 2/2004 Kludjian et al.
D500,888 S 1/2005 Gray
D508,586 S 8/2005 Shurtleff
D512,795 S 12/2005 Carpenter
D513,540 S * 1/2006 Wonderley ..... D28/46
7,028,407 B2 4/2006 Ehrlich et al.
7,140,115 B2 11/2006 Greene
7,155,828 B2 1/2007 Guimont et al.
7,197,827 B2 4/2007 Paquette
D541,987 S * 5/2007 Sugawara ..... D28/46
D542,468 S * 5/2007 Stiles ..... D28/46
D558,396 S 12/2007 Sierra et al.
D560,032 S 1/2008 Lopez
D587,846 S * 3/2009 Wonderley ..... D28/48
D599,955 S 9/2009 Provost
D603,560 S 11/2009 Micinilio
D612,540 S 3/2010 Joslin
D619,763 S 7/2010 Coresh
D621,095 S 8/2010 Cataudella
7,802,353 B2 9/2010 Gratsias et al.
D627,929 S 11/2010 Haba
7,882,610 B2 2/2011 Gratsias et al.
D635,302 S * 3/2011 Psimadas ..... D28/48
D636,938 S 4/2011 White, Jr. et al.
7,975,389 B2 7/2011 Bozikis et al.
D650,527 S 12/2011 Andersen et al.
D667,168 S * 9/2012 Greene ..... D28/48
8,273,205 B2 9/2012 Murgida
D703,377 S * 4/2014 Christie ..... D28/48
8,720,072 B2 5/2014 Bucco
8,739,411 B2 6/2014 Kinghorn et al.
9,108,329 B2 * 8/2015 Stiles ..... B26B 21/16
9,393,708 B2 7/2016 Babaev
D763,506 S * 8/2016 Barrett ..... D28/46
10,406,704 B2 * 9/2019 Barrett ..... B26B 21/4025
10,538,005 B2 * 1/2020 Barrett ..... B26B 21/4031
D917,176 S * 4/2021 Zhang ..... D4/138

(56) References Cited

U.S. PATENT DOCUMENTS

| | | | | |
|---|---|---|---|---|
| 11,141,872 | B2 * | 10/2021 | Barrett | B26B 21/4031 |
| 2002/0066186 | A1 | 6/2002 | White et al. | |
| 2002/0116822 | A1 | 8/2002 | Coffin | |
| 2004/0181954 | A1 | 9/2004 | Follo et al. | |
| 2005/0000100 | A1 | 1/2005 | Coffin | |
| 2007/0251106 | A1 | 11/2007 | Gladstone | |
| 2010/0205808 | A1 | 8/2010 | King | |
| 2011/0016724 | A1 | 1/2011 | Murgida | |
| 2012/0096718 | A1 | 4/2012 | Howell et al. | |
| 2012/0096723 | A1 | 4/2012 | Howell et al. | |
| 2012/0233868 | A1 | 9/2012 | Bridges et al. | |
| 2013/0047449 | A1 | 2/2013 | Zakuskin | |
| 2013/0081291 | A1 | 4/2013 | Wain et al. | |
| 2014/0101947 | A1 | 4/2014 | Samuels et al. | |
| 2014/0116211 | A1 | 5/2014 | Griffin et al. | |
| 2014/0230256 | A1 * | 8/2014 | Christie | B26B 21/527 30/526 |
| 2014/0331500 | A1 | 11/2014 | Ren | |
| 2015/0183119 | A1 * | 7/2015 | Contaldi | B26B 21/527 30/50 |
| 2017/0050327 | A1 * | 2/2017 | Alam | B26B 21/446 |
| 2018/0111279 | A1 * | 4/2018 | Barrett | B26B 21/4031 |
| 2022/0072724 | A1 * | 3/2022 | Barrett | B26B 21/521 |

* cited by examiner

RAZOR APPARATUS AND SHAVING SYSTEM

CROSS-REFERENCE TO RELATED APPLICATIONS

The present application is a continuation of U.S. application Ser. No. 14/875,484 filed Oct. 5, 2015 (now U.S. Pat. No. 10,406,704), which claims priority to U.S. Provisional Appl. No. 62/060,410 filed Oct. 6, 2014; U.S. Provisional Appl. No. 62/135,592 filed Mar. 19, 2015; and U.S. Provisional Appl. No. 62/174,067 filed Jun. 11, 2015; each of which is hereby incorporated by reference in its entirety.

TECHNICAL FIELD

This disclosure relates generally to shaving tools and systems thereof, and more particularly to a razor for securing a blade and accessories for shaving.

BACKGROUND

In the early to mid-20th century, both single and double edge safety razor tools were developed to replace the straight edge razor. Gillette® and Schick® were major competitors in this market. Some of the disadvantages of these early safety razors were:

i) the head of the blade tool holding the blade did not pivot;

ii) the handle and head of the tool were not ergonomically designed; and iii) the replaceable blades were made of materials that quickly caused the blade to become dull and rusted, thereby limiting the number of shaves with the razor before the razor blade needed to be replaced.

More recently the leaders in the shaving razor industry have focused on developing and refining pivotable head, multiple-blade cartridge razor tools where the multiple blade cartridge was easily replaceable, thereby providing the manufacturer with a continuing market for replacement razor cartridges. Although the initial cost of the pivotable head, multi-blade cartridge razor tool is moderate, the price of the replaceable multiple blade cartridges continues to escalate with each new design release and the materials used for the cartridges and blades are not durable, such that the cost of a shave continues to increase.

Therefore there is a need for an ergonomically designed, pivotable head, single blade razor with replaceable single edge blades made of more modern materials that remains sharp for many shaves The following United States patents and published application provide additional background information:

U.S. Pat. No. 5,048,184 discloses slot blade holder consisting of a mechanism for securing the rear flange of a standard single edge razor blade at its central aperture (FIGS. 1-5; Column 2, Lines 12-44; Claims 1-6).

2002/0066186 discloses a blade formed from a single crystal ceramic material with mounting and positioning the blade (cutting element) in a blade unit, and guard element is disposed forwardly of the cutting edge and extends parallel thereto (FIG. 1; Paragraphs [0009]-[0011]; Claims 2-7.

U.S. Pat. No. 5,953,824 discloses permitting the razor head to move relative to the razor allowing a razor head to swivel and also to pivot about an axis normal to a central axis of the razor and normal to an imaginary axis defined by the points of attachment of the razor to a razor head (FIGS. 1-3; Column 2, Lines 50-64; Claims 1-16).

U.S. Pat. No. 3,605,265 discloses razor head with a compartment extending from a head frontal opening to a head rearward opening, the drawer into its forward position, cause the blade cutting edge to be exposed through the bridge to a controlled extent at the proper cutting angle, resilient means are employed to bias the drawer into its retracted position upon release of the latch means to expedite blade interchange and cleansing (FIGS. 1-4; Column 2, Lines 44-68; Claims 10-12).

U.S. Pat. No. 3,067,512 discloses razor comprising a pair of blade clamping members with novel cutting edge guard which means movable relatively thereto from normal safety position; to two successive operating positions (FIGS. 1-4; Column 2, Lines 16-55; Claims 1-5).

SUMMARY

A shaving razor apparatus of the present disclosure provides:

a) a shaving tool having (i) a handle; and (ii) a head including a blade receiving and holding mechanism for receiving and holding a single edge razor blade suitable for cutting hair follicles;

(b) a single edge blade having a single sharpened edge and a more rounded non-sharpened edge wherein the sharpened edge is suitable for cutting hair follicles and wherein the blade also has a slot formed therein and configured to be received and held by the head of the shaving tool;

(c) means for pivotally mounting the head on one end of the handle;

(d) wherein the head includes a slot on back of the head for receiving the sharpened edge of the single edge blade, an opening in the front of the head for receiving the sharpened edge of the single edge blade, a plurality of ramp guides for directing the received single edge blade toward the front opening in the head until the single edge blade snaps into the home position of blade retainers that engage complimentary structures on the blade that positions the sharpened edge of the single edge razor through the opening in the front of the head to permit the user to fine tune the position of the edge of the razor;

(e) wherein the single edge razor blade is made of a solid material resistant to damage from hair follicles, rust, or corrosion; and (f) wherein the handle has a non-circular cross-section and is ergonomically designed to evenly balance the weight of the handle while permitting the user to firmly grip the handle during use.

Additional specific embodiments provide a blade adjustment system for user customization of the degree of aggressiveness of the extension of the blade from the razor head.

The described invention depicts a high-quality single edge razor tool that provides the user with a very durable safety razor that gives the user many very close shaves with a single blade before it is necessary to replace the blade. The known prior art does not disclose the elements and advantage of the invention summarized above.

Notation and Nomenclature

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The present invention contemplates a shaving system that includes not only the razor assembly described above and shown in FIGS. 1-16 but also shaving accessories such as a stand for the razor assembly, a soap brush and a stand for the soap brush.

Figure 1:
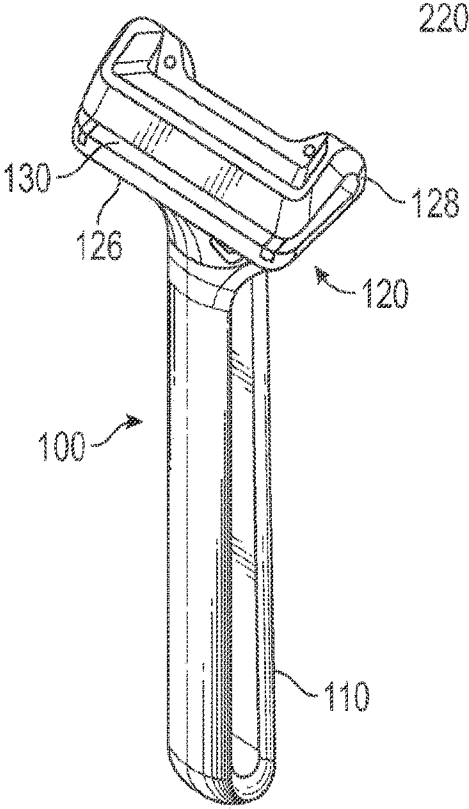
FIG. 1 is an isometric view of an exemplary embodiment of an assembled razor apparatus of the present disclosure.

FIG. 1 is an isometric view of an exemplary embodiment of an assembled razor apparatus of the present disclosure. Apparatus 100 has two principal components: handle 110 and head 120 mounted on handle 110. The front 126 of apparatus 100 is proximate and the back 128 is distal. A blade can be positioned in head 120 so as to rest in blade slot opening 130.

Figure 2:
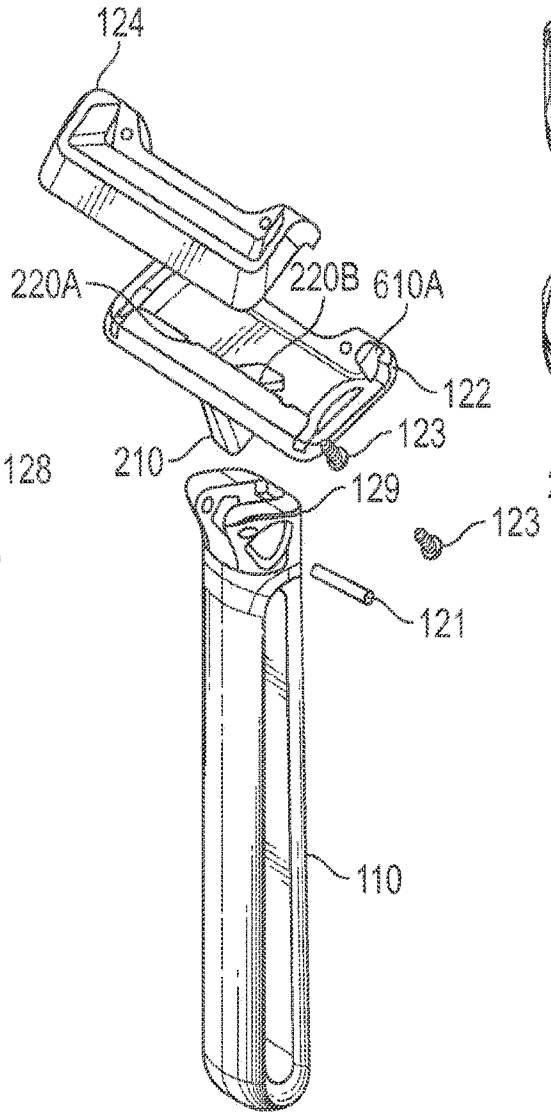
FIG. 2 is an isometric exploded view of the razor apparatus of FIG. 1.

FIG. 2 is an isometric exploded view of the razor apparatus of FIG. 1. Head 120 is assembled from head bottom portion 122 and head top portion 124 is mounted onto to head bottom portion 122 with screws 123. The underside of head bottom portion 122 extends to provide a pivot weight 210. The head end 129 of handle 110 provides a channel or track 127 to receive pivot weight 210. Pin 121 inserts through head end 129 at pin hole 805 (FIG. 8) and pivot weight 210 to serve as an axle about which head 120 pivots or rocks.

Figure 6:
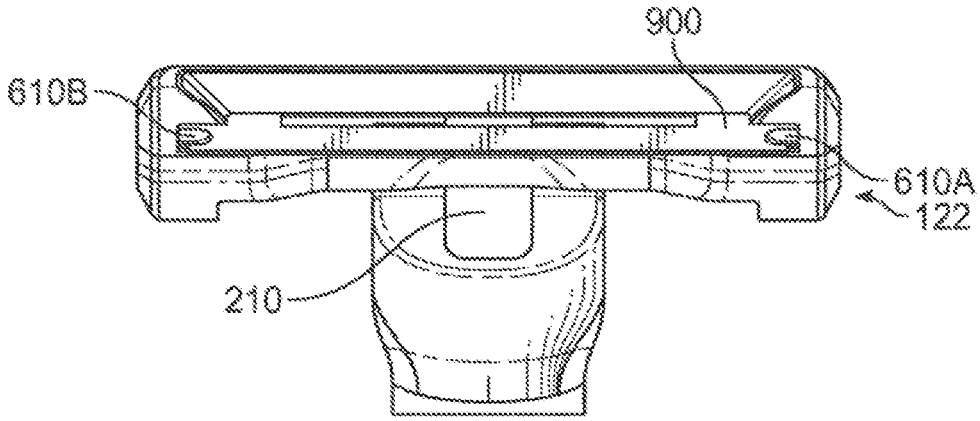
FIG. 6 is a rear view illustration of a detail of a head bottom of the present disclosure.

A shaving system of the present disclosure provides one or more blades 900 (FIG. 6). A blade is positioned between head bottom portion 122 and head top portion 124 by sliding single-edge blade 900 through blade slot 130 (FIG. 12) such that the dull end of blade 900 is secured by blade retainers 610A/610B and the sharp edge of blade 900 rests on supports 220A/220B.

Figure 3:
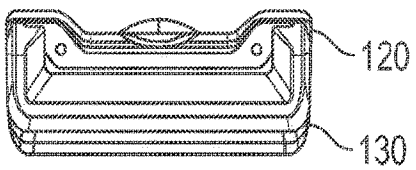
FIG. 3 is an isometric front top view of the head of the shaving apparatus of FIG. 1.

FIG. 3 is an isometric front top view of the head of the shaving apparatus of FIG. 1. Head 120 provides blade slot opening 130.

Figure 4:
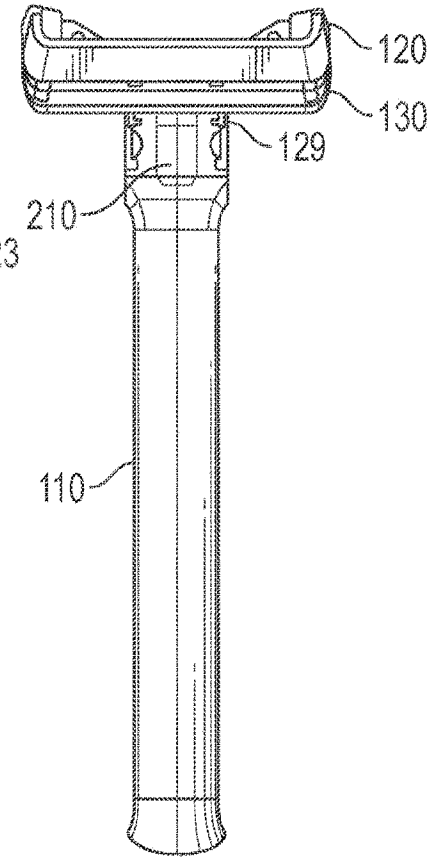
FIG. 4 is an isometric front view of the shaving apparatus of FIG. 1.

FIG. 4 is an isometric front view of the shaving apparatus of FIG. 1. Head 120 with blade slot opening 130 is mounted to the head end 129 of handle 110. Pivot weight 210 is disposed in channel 127.

Figure 5:
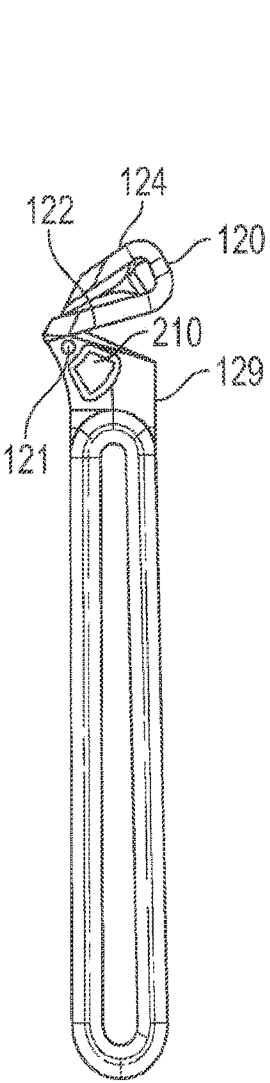
FIG. 5 is an isometric side view of the shaving apparatus of FIG. 1.

FIG. 5 is an isometric side view of the shaving apparatus of FIG. 1. Head 120 is mounted to head end 129 of handle 120 with pin 121.

Figure 7A:
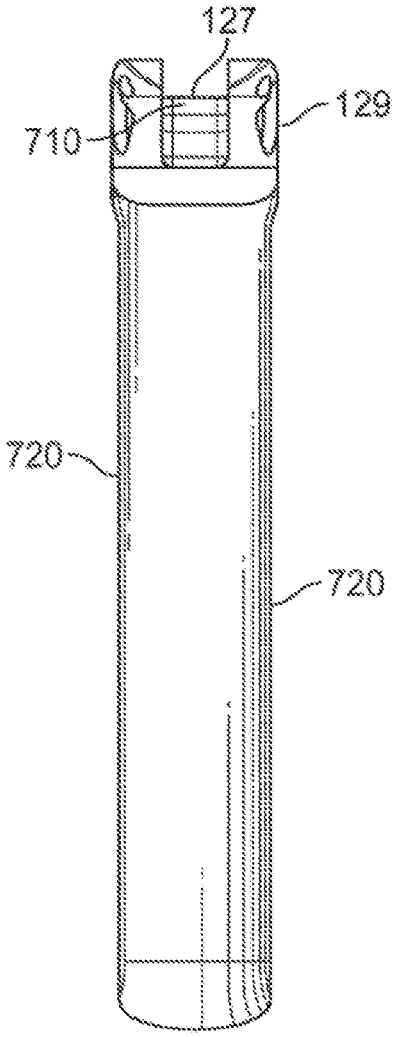
FIG. 7A is a front view illustration of a handle of a shaving apparatus of the present disclosure.

FIG. 6 is a rear view illustration of a detail of a head bottom of the present disclosure. Blade 900 rests on the top surface of head bottom 122, retained by dual blade retainers, blade retainer 610A located on a first side of head bottom 122 and blade retainer 610B on a second side of head bottom 122. As shown in FIG. 6, blade retainers 610A-B are retaining posts configured to mate with respective recesses in blade 900 to retain the blade within the head. Tight tolerances for blade insertion into the razor head create a slight tension bias in the blade so that the blade snaps into position within the razor head FIG. 7A is a front view illustration of a handle of a shaving apparatus of the present disclosure. Pivot weight channel 127 at head end 129 provides a pivot stop 710, such as, for example, a lip or surface curvature discontinuity that engages a pivot stop structure of head 120 pivot weight 210. Beveled edge surface 720 provides ergonomic manual grippability.

Figure 7B:
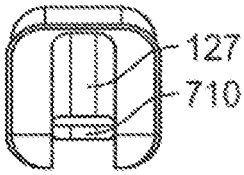
FIG. 7B is a top view of the handle of FIG. 7A.

FIG. 7B is a top view of the handle of FIG. 7A. Pivot stop 710 is formed in pivot weight channel 127.

Figure 8:
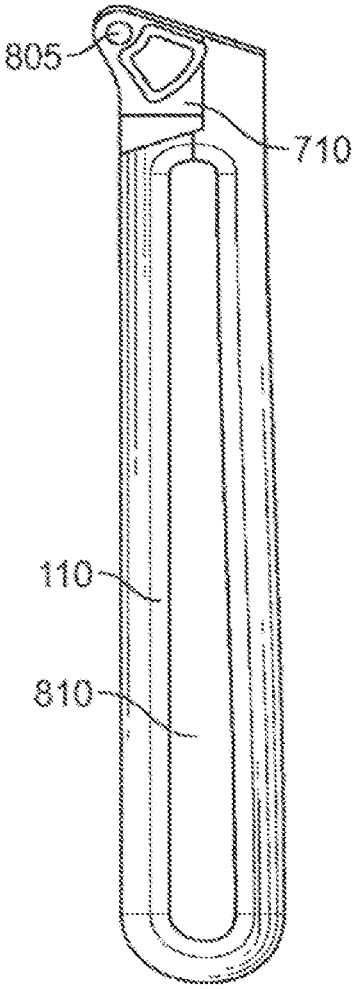
FIG. 8 is a side view illustration of the handle of FIG. 7A.

FIG. 8 is a side view illustration of the handle of FIG. 7A. Head end 129 is in partial cross-section and depicts a portion of pivot weight 210 disposed in channel 127 near pin hole 805 which houses pin 121. The shape of handle 110 is an elongated torus formed around the void of handle slot 810. Edge 720 provides a sharp bevel around slot 810 for ergonomic manual grip while preserving a smooth, polished surface to handle 110 as a whole.

Figure 9A:
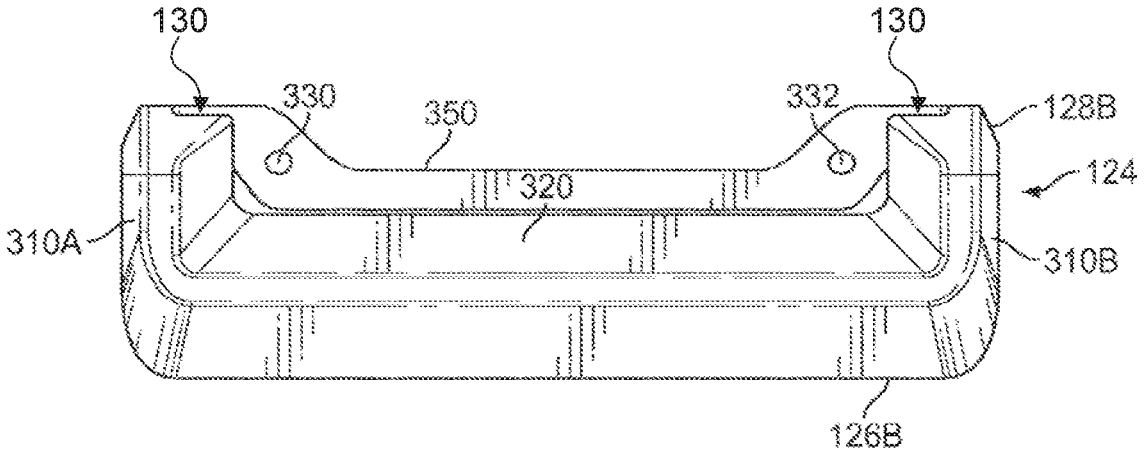
FIG. 9A is a diagrammatic illustration of a top isometric view of an exemplary embodiment of a head top of the present razor apparatus.

FIG. 9A is a diagrammatic illustration of a top isometric view of an exemplary embodiment of a head top of the present razor apparatus. Head top 124 is a toroidal shape formed by front surface 126B, rear portion 128B, and left and right side portion 310A/310B, respectively, said portions surrounding head opening 320. Screw holes 330/332 receive screws 123 to mount head top 124 to head bottom 122. Rear portion 128B is disposed slightly below front surface 126B to provide a mounting shelf 350 for attaching head top 124 to head bottom 122. The offset of rear portion 128B below front surface 126B also form a blade receiving slot 130 into which a blade of a shaving system of the present disclosure is inserted.

Figure 9B:
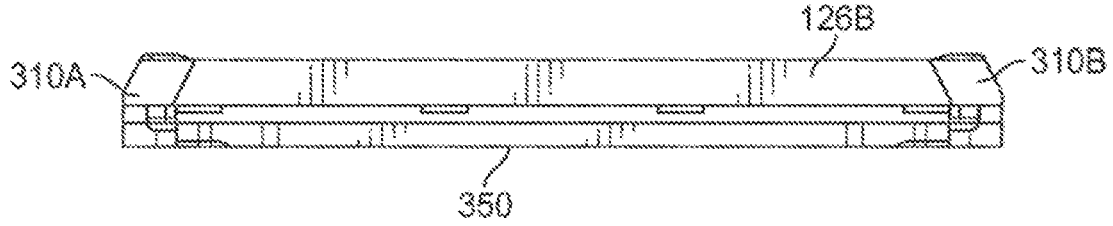
FIG. 9B is a diagrammatic illustration of a front isometric view of the head top of FIG. 9A.

FIG. 9B is a diagrammatic illustration of a front isometric view of the head top of FIG. 9A. Front surface 126B spans between side portions 310A/310B. Mounting shelf 350 is slightly below front surface 126B to form blade receiving slot 130 (not shown in FIG. 9B).

Figure 9C:
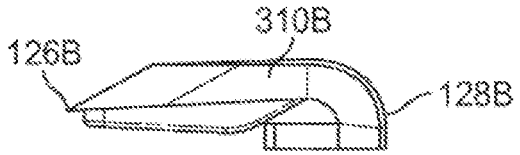
FIG. 9C is a diagrammatic illustration of a side isometric view of the head top of FIG. 9A.

FIG. 9C is a diagrammatic illustration of a side isometric view of the head top of FIG. 9A. Mounting shelf 350 extends toward front surface 126B from rear portion 128B to provide a surface for screw holes 330/332.

Figure 10A:
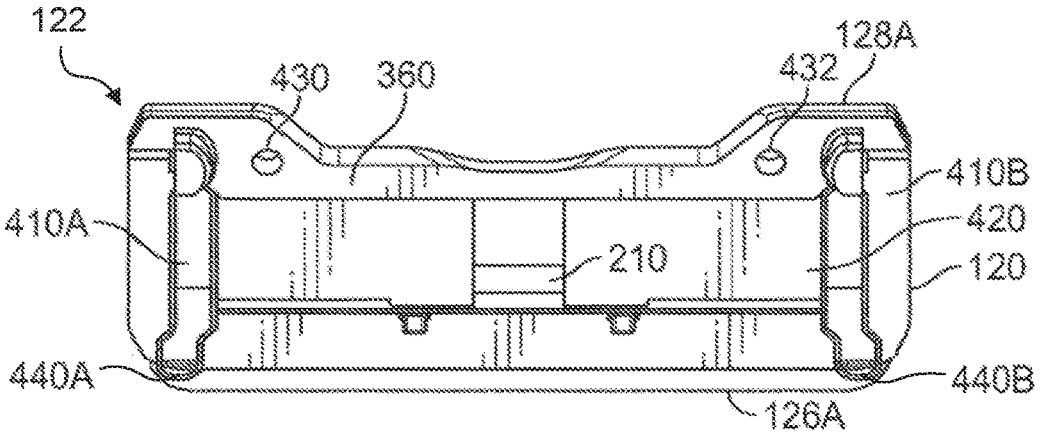
FIG. 10A is a top view of an exemplary embodiment of a head bottom of the present razor apparatus.
Figure 10B:
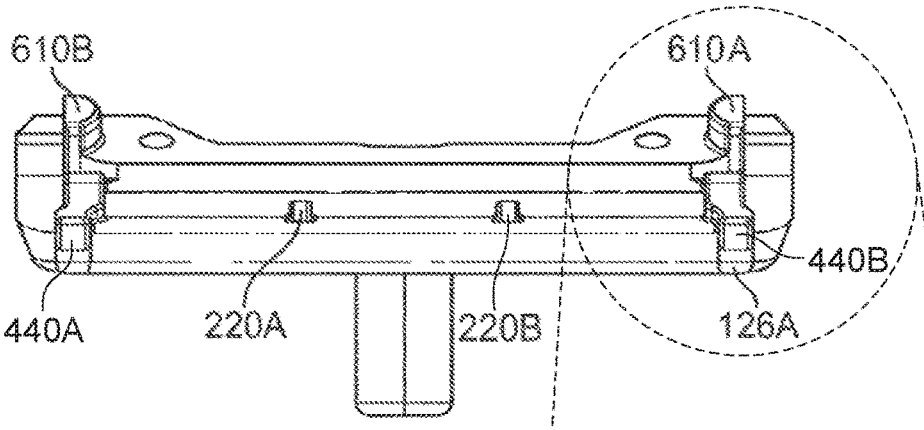
FIG. 10B is a front view of an exemplary embodiment of the head bottom of the razor apparatus of FIG. 10A.

FIGS. 10A-10B show a top view of an exemplary embodiment of a head bottom of the present razor apparatus, and a front view of the same, respectively. Head bottom 122 is a toroidal shape formed by front surface 126A, rear portion 128A, and left and right side portion 410A/410B, respectively, said portions surrounding head opening 420. Looking down through opening 420, pivot weight 210 is partially visible. Head bottom rear portion 128A extends between side portions 410A and 410B, respectively, to provide a mounting surface 360 for attachment to head upper member 124 with screw holes 430/432. Blade supports 220A/220B extend up from the top surface of front surface 126A. Blade stops 440A/440B disposed to either side of blade supports 220A/220B help secure a blade in shaving position. Pivot weight 210 is centered under head bottom 122.

Blade retainers 610A/610B extend upward from the top lateral surface of rear portion 128A. Front surface 126A provides a slight amount of flex for a degree of forgiveness in relation to the force applied to the razor head during shaving so that the register of the blade/skin contact is enhanced while shaving.

Figure 11:
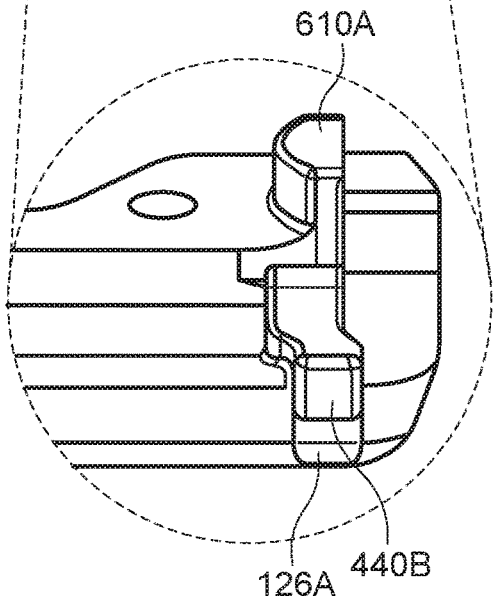
FIG. 11 is a diagrammatic isometric illustration side view of a detail of the head bottom of FIG. 10A.
Figure 11:
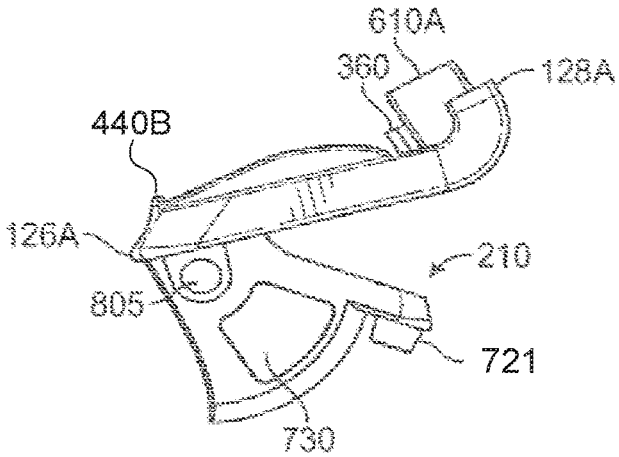

FIG. 11 is a diagrammatic isometric illustration side view of a detail of head bottom 122. Pivot weight 210 depends from the middle of head bottom 122. Pivot stop 721 engages with pivot stop 710 of channel 127 in handle 110 to inhibit over-pivoting of head 120. Pivot weight 210 is toroidal in shape, having void 730 formed by a hole through pivot weight 210. A spring disposed in head channel 127 engages pivot weight 210 and channel surface 710 to provide an amount of control of the pivot motion by a user.

Figure 12:
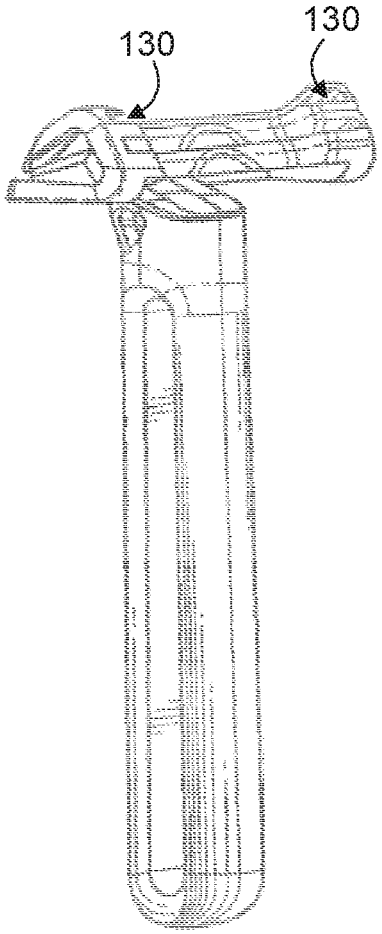
FIG. 12 is a diagrammatic isometric rear view illustration of an exemplary embodiment of a shaving tool of the present disclosure.

FIG. 12 is a diagrammatic isometric rear view illustration of an exemplary embodiment of a shaving tool of the present disclosure. Blade slot 130 is provided for insertion of a blade to engage with blade retainers 610A and 610B for shaving.

Figure 13:
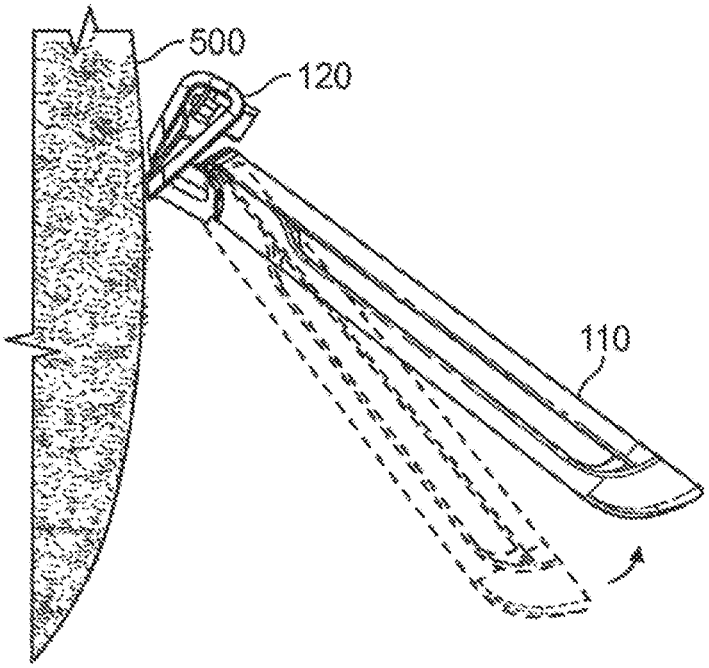
FIG. 13 is a side view diagrammatic illustration of a razor apparatus of the present disclosure.

FIG. 13 is a side view diagrammatic illustration of a razor apparatus of the present disclosure. Razor head 120 pivots as a user presses the registration surface(s) surrounding the blades, principally front surfaces 126A and 126B, against skin 500. The pivoting maintains the proper register or shaving angle of head 120 even when the user is changing the position of handle 110. It can be seen in FIG. 13 that both registration surfaces 126A-B define respective planes, and that the cutting edge of the blade protrudes past both planes of the registration surfaces to engage the skin.

Figure 14:
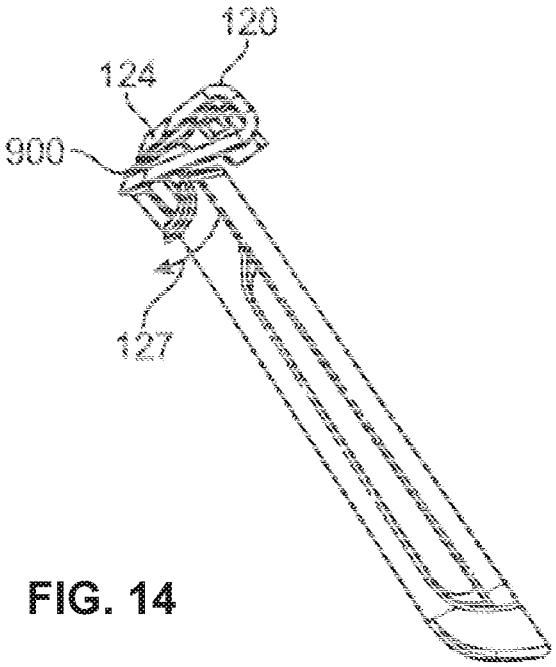
FIG. 14 is a side view diagrammatic illustration of a razor apparatus of FIG. 13.

FIG. 14 is a side view diagrammatic illustration of a razor apparatus of FIG. 13. Pivoting is enacted by applying a normal force to the top 124 of head 120 (via the registration surface(s), e.g., surfaces 126A, B) which is oriented tangentially to the perimeter of the curved track of channel 127.

A shaving system of the present invention provides one or more blades, a razor stand, a soap brush and a brush stand in addition to the razor apparatus described above.

Figure 15A:
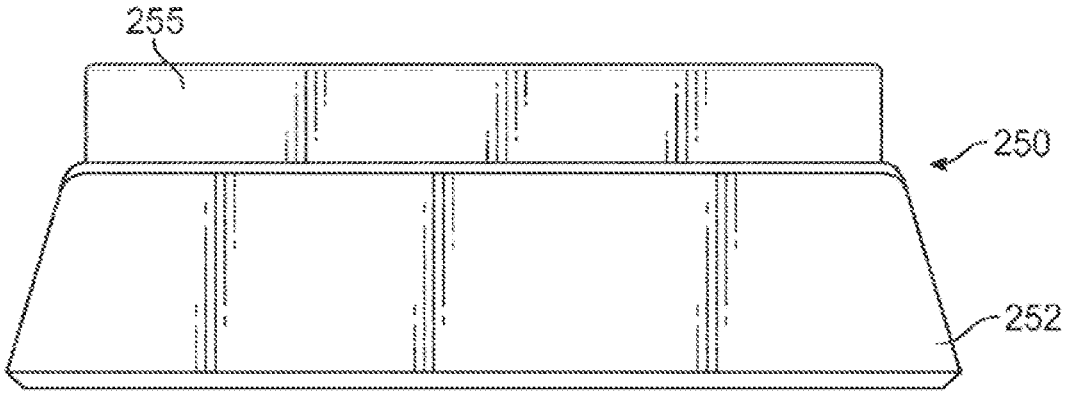
FIG. 15A is a front view illustration of a razor stand of the present shaving system.
Figure 15B:
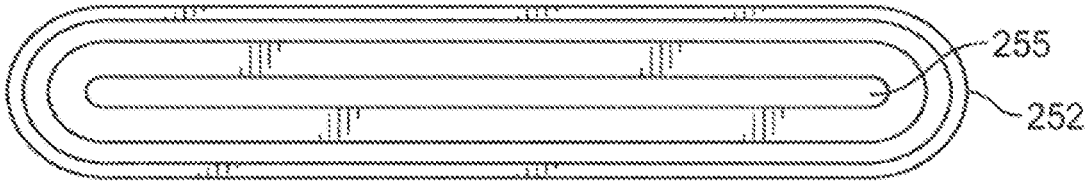
FIG. 15B is a top view of the razor stand of FIG. 15A.
Figure 15C:
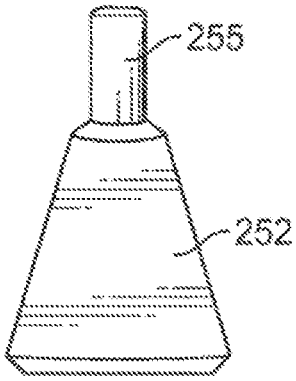
FIG. 15C is a side view of the razor stand of FIG. 15A.
Figure 15D:
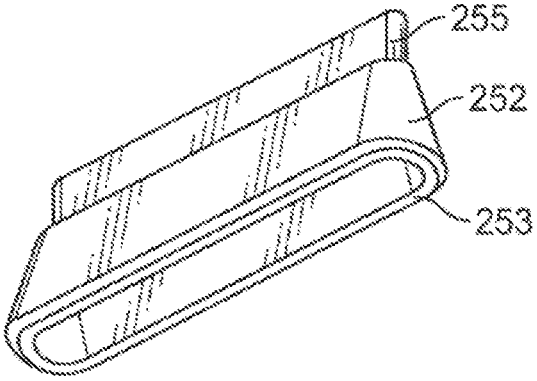
FIG. 15D is an isometric bottom view of an alternative embodiment of the shaving stand of FIG. 15A.

FIGS. 15A-15D illustrate diagrammatically a razor stand of a shaving system of the present invention. FIG. 15A is a front view illustration of a razor stand 250 of the present shaving system. Base 252 supports holder 255. Slot 810 of handle 110 fits over holder 255 so that razor 100 rests elevated off of a surface such as a bathroom counter top or shower shelf. FIG. 15B is a top view of the razor stand of FIG. 15A. The shape of the stand is substantially ovoid. FIG. 15C is a side view of the razor stand of FIG. 15A. The bottom of base 252 is wider than holder 255 to provide stability. FIG. 15D is an isometric bottom view of an alternative embodiment of the shaving stand of FIG. 15A. The bottom of base 252 is rimmed with a gripping pad 253 made of rubber of othersuitable non-skid material to enhance the stability of base 250. Other alternative exemplary embodiments provide a weighted base 252 of additional enhancement of stability.

Figure 16:
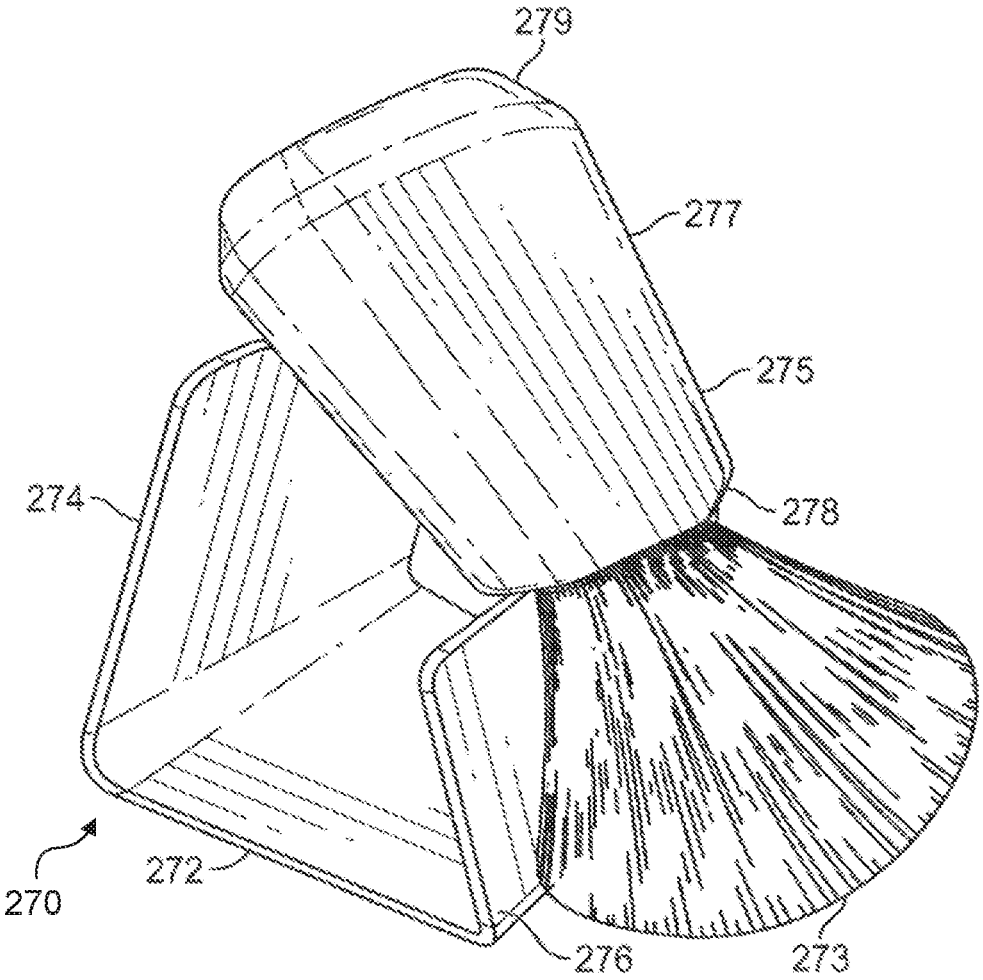
FIG. 16 is an isometric diagrammatic illustration of an exemplary embodiment of a brush stand of a shaving system of the present disclosure.

FIG. 16 is an isometric diagrammatic illustration of a brush stand of the present disclosure. Another component of a shaving system of the present disclosure is a brush stand. Stand 270 is a unitary piece of material bent in the front and the back to form a stand to support a brush 275. Front panel 276 is bent vertically from the base at an acute angle from base panel 272. Back panel 274 is bent vertically from the base at a slightly less acute angle from base 272 than is front panel 276. Brush 275 has bristles 273 and handle 277. Back panel 274 is taller than front panel 276. In operation, the bristle end 278 of the handle 277 of brush 275 rests on the top of front panel 276. The distal portion 279 of handle 275 rests on the top of back panel 274. The length of the handle 278 of brush 275 and the angle of back panel 274 cooperate such that brush 275 is not knocked off of stand 270 when stand 270 is place near a wall or splash guard.

The pivot mechanism of a razor apparatus of the present disclosure, in combination with the flex of the head portion allows a registration surface (e.g., surfaces 126A-B) to enable a user to tactilely feel when the surface is flat against his or her skin and when the registration surface is not flat on the skin.

Blade latching allow for quick and easy blade changes.

Blade corner guards such as blade stops 440*a*/440B allow for very safe shaving in the area under the nose without risk of cutting oneself.

Ergonomic handle grip design uses the sharp beveled edges of the handle cut-out opening to provide high friction grip for effective use in wet and soapy conditions.

Blade exposure is adjustable with the use of blades with cut-out locations that engage blade retainers 610A/610B at slightly different locations on the sides of the blade, for example, so that the blade extends more less forward in accordance with user preferences. Additional blade exposure adjustment mechanisms, such as a rack and pinion assembly that engages the blade, are contemplated in alternative embodiments.

Adjustable blades with our current razor where we offer 2-3 blades with slightly different cutout locations in the blades such that the blades would locate differently in the razor head thus providing either a more aggressive or less aggressive cutting scenario, depending on which blade was chosen.

Many modifications and other embodiments of the razor apparatus and shaving system described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A razor apparatus, comprising:

a handle; and a head coupled to the handle, wherein the head includes:

a front side portion including a first registration surface that defines a plane, wherein the front side portion is configured to expose a cutting edge of a removable single blade past the plane of the first registration surface;

at least one blade support is attached to and extends from a top surface of the front side portion;

a first blade corner guard positioned at a first corner of the front side portion of the head; and a second blade corner guard positioned at a second corner of the front side portion of the head;

wherein the blade corner guards are configured to prevent skin contact with respective corners of the cutting edge of the single blade during use.

2. The razor apparatus of claim 1, wherein the head includes a rear side portion including an aperture configured to receive the single blade.

3. The razor apparatus of claim 2, wherein the head comprises a top portion and a bottom portion that define the aperture, wherein the bottom portion includes the first registration surface and is proximate the handle, and wherein the top portion is mounted on the bottom portion and is secured thereto with a plurality of screws.

4. The razor apparatus of claim 1, wherein the head includes a plurality of retaining posts configured to mate with respective recesses in the single blade to retain the single blade within the head.

5. The razor apparatus of claim 1, wherein the handle has a recess extending through a width of the handle along a portion of a length of the handle, wherein a pair of opposing beveled edges of the handle define the recess, and wherein the recess extends through the width of the handle.

6. The razor apparatus of claim 5, wherein the pair of opposing beveled edges of the recess facilitate repeatable gripping of the razor apparatus by a user.

7. The razor apparatus of claim 1, wherein the front side portion includes a second registration surface that defines a plane that is not identical to the plane defined by the first registration surface.

8. The razor apparatus of claim 1, wherein the head is pivotably coupled to the handle, and wherein the head is configured to pivot about a pivot axis.

9. The razor apparatus of claim 8, wherein the handle includes a channel, the razor apparatus further comprising a first pivot stop disposed in the channel and a second pivot stop on the head, wherein the first pivot stop is configured to engage the second pivot stop to inhibit over-pivoting of the head.

10. The razor apparatus of claim 8, wherein the pivot axis is off-center relative to the handle and is closer to a front side of the handle as compared to a rear side of the handle, and wherein the rear side of the handle corresponds to the rear side of the head.

11. The razor apparatus of claim 1, wherein the blade corner guards comprise blade stops.

12. The razor apparatus of claim 1, wherein the head includes a rear side portion attached to the front side portion with two side portions.

13. The razor apparatus of claim 12, wherein the head includes an opening between the front side portion and the rear side portion.

14. A razor apparatus, comprising:

a handle; and a head coupled to the handle, wherein the head includes:

a front side portion including a first registration surface that defines a plane, wherein the front side portion is configured to expose a cutting edge of a removable single blade past the plane of the first registration surface;

at least one blade support attached to the front side portion;

a first blade stop positioned at a first corner of the front side portion of the head; and a second blade stop positioned at a second corner of the front side portion of the head;

wherein the blade stops are configured to prevent skin contact with respective corners of the cutting edge of the single blade during use.

15. The razor apparatus of claim 14, wherein the at least one blade support is attached to and extends from a top surface of the front side portion.

16. The razor apparatus of claim 14, wherein the head includes:

a rear side portion attached to the front side portion with two side portions; and an opening between the front side portion and the rear side portion.

17. A razor apparatus, comprising:

a handle; and a head coupled to the handle, wherein the head includes:

a front portion including a first registration surface that defines a plane, wherein the front portion is configured to expose a cutting edge of a removable single blade past the plane of the first registration surface;

a rear portion;

two side portions attaching the front portion to the rear portion;

at least one blade support attached to the front portion;

a first blade corner guard positioned at a first corner of the front portion of the head; and a second blade corner guard positioned at a second corner of the front portion of the head;

wherein the blade corner guards are configured to prevent skin contact with respective corners of the cutting edge of the single blade during use.

18. The razor apparatus of claim 17, wherein the head includes an opening between the front portion and the rear portion.

19. The razor apparatus of claim 17, wherein the at least one blade support is attached to and extends from a top surface of the front portion.

20. The razor apparatus of claim 17, wherein the rear portion includes an aperture configured to receive the single blade.

* * * * *